US010501257B2

(12) United States Patent
Ruthe-Steinsiek

(10) Patent No.: US 10,501,257 B2
(45) Date of Patent: Dec. 10, 2019

(54) METERING DEVICE

(71) Applicant: Henkel AG & Co. KGaA, Duesseldorf (DE)

(72) Inventor: Kai Ruthe-Steinsiek, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 16/239,805

(22) Filed: Jan. 4, 2019

(65) Prior Publication Data

US 2019/0135524 A1 May 9, 2019

Related U.S. Application Data

(63) Continuation of application No. PCT/EP2017/066963, filed on Jul. 6, 2017.

(30) Foreign Application Priority Data

Jul. 7, 2016 (DE) ..... 10 2016 212 377

(51) Int. Cl.
*B65D 83/00* (2006.01)

(52) U.S. Cl.
CPC ..... *B65D 83/0022* (2013.01)

(58) Field of Classification Search
CPC ..... B65D 81/325; B65D 83/0005; B65D 83/002; C11D 17/041
(Continued)

(56) References Cited

U.S. PATENT DOCUMENTS 4,273,257 A * 6/1981 Smith ..... B01L 3/0206 222/309
4,467,942 A * 8/1984 Oshikubo ..... G01F 11/06 222/287
(Continued)

FOREIGN PATENT DOCUMENTS

DE 3048520 A1 7/1982
DE 3109333 A1 9/1982
(Continued)

OTHER PUBLICATIONS

International Search Report for International PCT Patent Application No. PCT/EP2017/066963 dated Sep. 28, 2017.

*Primary Examiner* — Vishal Pancholi
(74) *Attorney, Agent, or Firm* — James E. Piotrowski

(57) ABSTRACT

The invention relates to a metering device (1) for the metered application of a highly viscous product onto a substrate (2), comprising a housing (3) with an inner side (7) and an outer side (6), a cartridge (10) forming a receiving space (14) for the highly viscous product to be metered, a piston (20) and a spring element (17), wherein at least one engaging element (22) is formed on the inner side (7) of the housing (3) and a row of neighboring engaging recesses (21) is formed on the piston (20), wherein both the engaging element (22) and the engaging recesses (21) are arranged outside of the receiving space (14), and wherein the engaging element (22) engages into an engaging recess (21) on the piston (20) with an actuation of the metering device (1), and wherein, after an actuation of the metering device (1), a returning movement of the housing (3) into the starting position thereof brings about a transition of the engaging element (22) from the engaging recess (21) into a neighboring engaging recess (21).

13 Claims, 4 Drawing Sheets

(58) Field of Classification Search
USPC ..... 222/48–50, 173, 185, 185.1, 386;
401/137, 150, 173, 176, 182
See application file for complete search history.

(56) References Cited

U.S. PATENT DOCUMENTS

| | | | | | |
|---|---|---|---|---|---|
| 5,747,709 | A * | 5/1998 | Oshikubo | B01L 3/0234 | 222/287 |
| 6,159,181 | A * | 12/2000 | Crossman | A61M 5/2033 | 604/134 |
| 7,520,406 | B2 | 4/2009 | Jaichandra et al. | | |
| 8,486,003 | B2 * | 7/2013 | Nielsen | A61M 5/158 | 604/198 |
| 8,814,456 | B2 * | 8/2014 | Schultz | B65D 83/0022 | 401/137 |
| 8,851,339 | B2 * | 10/2014 | Schultz | B65D 83/0005 | 222/386 |
| 9,212,476 | B2 * | 12/2015 | Muhlhausen | E03D 9/005 | |

FOREIGN PATENT DOCUMENTS

| | | | |
|---|---|---|---|
| DE | 9109611 | U1 | 10/1991 |
| EP | 0248278 | A2 | 12/1987 |
| FR | 1596074 | A | 6/1970 |
| FR | 2509980 | A1 | 1/1983 |
| FR | 2855504 | A1 | 12/2004 |
| WO | 2007043092 | A1 | 4/2007 |
| WO | 2011112254 | A1 | 9/2011 |

* cited by examiner

METERING DEVICE

The present invention relates to a metering device for the metered application of a highly viscous product onto a substrate.

The highly viscous product can be any type of pasty materials, in particular pasty materials that can be described as firm. A firm highly viscous product is understood to mean a product which does not drip or run during application, since it is barely fluid. Such a property is important above all during application on vertical or overhead surfaces. Examples of such highly viscous products are adhesives, products in the cleaning agent sector, such as, for example, a self-adhesive WC gel, cosmetic products such as, for example, a cream or a gel, or also certain foods such as butter or a spread.

In the sense of the present invention, adhesives, in particular structural adhesives, can be considered in particular as highly viscous products. They may be water-based systems, solvent-containing systems or reactive systems, for example. Such substances are commonly sold in standard cartridges, and the user needs a suitable cartridge gun to dispense the product from the cartridge.

However, cartridge guns are cumbersome and consequently sometimes difficult to handle for the untrained user. Moreover, often the product quantity sold in commercial cartridges is too large for smaller uses in the do-it-yourself sector, so that the consumer risks not being able to use some of the product purchased.

As an alternative to cartridges, highly viscous products such as structural adhesives, for example, are also marketed in tubes. In fact, these tubes are also available in smaller filling quantities, but difficulties can arise during the dispensing of the adhesive, especially in the case of a product having a particularly high viscosity and/or in the case of an already partially emptied tube. Often, a satisfactory and complete dispensing is possible here only with additional aids such as tube squeezers, for example.

From WO 2011/112254 A1, a metering device for dispensing a self-adhesive WC gel is known, which comprises an inner and an outer housing, a volume of self-adhesive product and an automatic dispensing mechanism. The dispensing mechanism includes a guide rod with a piston, wherein engaging elements are formed on the guide rod, which can interact with arms formed on the piston. A spring mechanism ensures that, after an actuation procedure, the device transitions again into a starting position. The guide rod is positioned within the product to be applied and is in contact with said product. By a single actuation of the metering device, a defined quantity of WC gel can be dispensed.

The device described in WO 2011/112254A1 is not suitable for metering structural adhesives, since, due to the position of the guide rod within the product mass, the absolute air and water vapor tightness of the system, which is required for structural adhesives, is not ensured. Via minute inclusions of air and/or moisture between guide rod and product or via product residues adhering to the guide rod, the curing of the adhesive can occur already within the metering device as a result of a capillary or bridging action.

Structural adhesives, in particular polymer-based moisture-curing structural adhesives, have extreme reactions to air and water vapor, and the curing mechanism is initiated immediately when they come in contact with said air and water vapor. To that extent, absolute air and water vapor tightness must be ensured in the area of the structural adhesive supply during storage and during the application of such adhesives.

The aim of the present invention consists in providing a metering device for the metered application of a highly viscous product, in particular of a structural adhesive, onto a substrate, by means of which the disadvantages of the prior art are circumvented.

This aim is achieved by a metering device having the features of claim 1.

Particular designs and developments of the invention are the subject matter of the dependent claims.

The invention relates to a metering device for the metered application of a highly viscous product onto a substrate, comprising:

- a housing with an inner side and an outer side, and a first end which faces the substrate during actuation of the metering device, and a second end opposite from the first end, wherein the housing comprises an opening in the area of the first end,
- a cartridge which is arranged at least substantially within the housing and which forms a receiving space for the highly viscous product to be metered, wherein the cartridge comprises a dispensing opening arranged in the area of the first end of the housing, through which the highly viscous product can be dispensed from the metering device,
- a piston which is arranged within the housing and at least partially within the cartridge and which forms a delimitation of the receiving space opposite the outlet opening, wherein, during the actuation of the metering device, a movement of the housing relative to the cartridge brings about a movement of the piston relative to the cartridge in the direction of the dispensing opening, whereby the highly viscous product can be dispensed through the dispensing opening from the cartridge,
- a spring element which is arranged between the inner side of the housing and the cartridge and which, with an actuation of the metering device, due to the movement of the housing relative to the cartridge, is prestressed in such a manner that, after actuation of the metering device, the housing is moved back again relative to the cartridge into the starting position thereof due to a resetting force of the spring element.

The inventive metering device is characterized in that at least one engaging element is formed on the inner side of the housing and in that a row of neighboring engaging recesses is formed on the piston, wherein both the engaging element and the engaging recesses are arranged outside of the receiving space, and wherein the engaging element engages into an engaging recess on the piston with an actuation of the metering device so that, due to a movement of the housing relative to the cartridge, a movement of the piston relative to the cartridge and thus a dispensing of the highly viscous product from the metering device can be brought about, and wherein, after an actuation of the metering device, the returning movement of the housing into the starting position thereof brings about a transition of the engaging element from the engaging recess into a neighboring engaging recess.

In the sense of the invention, an actuation of the metering device or an actuation procedure is understood to mean the setting of the metering device on a substrate to which the highly viscous product is to be applied and the movement of the housing in the direction of the substrate until a stop point is reached. The housing of the metering device serves here as a handle unit for a user. The stop point can be defined in that the housing, by means of the first end thereof, hits the substrate or in that, by means of the first end, it hits a stop implemented in another way on the metering device. In both cases, the movement of the housing onto the substrate is delimited by reaching the stop point. By such an actuation, for each actuation procedure, a precisely metered product quantity can be dispensed from the metering device. In principle, a movement of the housing which is stopped by the user already before the stop point is reached is also possible. However, in this way, a product quantity is dispensed which does not correspond to the metering quantity provided for.

The invention thus provides an engaging mechanism in which at least one engaging element formed on the inner side of the housing engages in engaging recesses formed on the piston, wherein both the engaging element and the engaging recesses are arranged outside of the receiving space and thus also outside of the product mass, so that they are not in contact with the highly viscous product to be metered. In this way, it is technically clearly simpler to form the receiving space so that it is air and water vapor tight. Thus, the inventive metering device is particularly suitable for the metered dispensing of products that cure rapidly when in contact with air and/or moisture, for example, structural adhesives. However, as already mentioned, various other highly viscous products can obviously also be applied to a substrate by means of the inventive metering device.

Moreover, by means of the inventive design, a sticking or clogging of components of the engaging mechanism, i.e., of the engaging element and of the engaging recesses, can be prevented, since said components are always arranged outside of the product mass. In this way, a reliable operation of the metering device can be ensured.

The engaging element and the engaging recesses interact in such a manner that, during the actuation of the metering device, due to the movement of the housing toward the substrate, the engaging element formed on the inner side of the housing and engaging into an engaging recess formed on the piston also moves the piston in actuation direction. After actuation of the metering device, i.e., for example, when the metering device is removed from the substrate to which the highly viscous product has been applied beforehand, the housing returns to its starting position relative to the cartridge, due to the resetting force generated by the spring element, while the piston does not also perform this returning movement, in particular due to friction between piston and cartridge. Instead, the piston remains in a position assumed during the actuation of the metering device, advanced in direction of the first end of the housing.

During the returning movement of the housing into its starting position, the engaging element transitions from the engaging recess into a neighboring engaging recess, in which it then remains until a next actuation of the metering device. For this purpose, the engaging element can be formed so it is slightly springy or flexible, so that the transition into a neighboring engaging recess is facilitated, in that the engaging element can be deflected slightly radially outwardly at the time of the transition from one engaging recess into a neighboring engaging recess.

The mechanism described thus overall ensures a successive advance of the piston within the cartridge with defined step width, whereby the highly viscous product to be metered can be dispensed with a metering quantity which always remains the same.

After each actuation procedure of the metering device, the housing returns into its starting position relative to the cartridge, while, with each actuation, the piston is always moved further within the housing and within the cartridge toward the first end of the housing. Since the piston at the same time forms a delimitation of the receiving space, this receiving space becomes smaller with each actuation of the metering device, in accordance with the remaining product volume still within the receiving space, which decreases with each actuation. After an actuation, the inventive metering device is immediately available for another actuation, without the user having to take certain measures for this purpose.

The product quantity dispensed during an actuation of the metering device depends on various parameters which are in each case fixed for a given metering device. These parameters are the cross-sectional area of the cartridge or of the piston and the stroke of the housing, to which the movement of the piston within the cartridge is coupled. The stroke of the housing is fixed by the distance by which the housing can be moved from its starting position to the stop point.

According to a design of the invention, the engaging recesses on the piston are delimited by engaging projections which comprise an upper side facing the second end of the housing and a lower side facing the first end of the housing, wherein, in the case of a metering device set on a substrate, the upper side of the engaging projections is oriented substantially parallel to the substrate, while the lower side is oriented at an angle of 30° and 60°, preferably at an angle of approximately 45° relative to the substrate. Due to the different orientation of lower side and upper side of the engaging projections, it is ensured that, during the actuation of the metering device, the engagement element firmly engages in the engaging recess and lies on the upper side of the engaging projections, in order to ensure in this way the transmission of the movement of the housing to the piston, while, after actuation of the metering device and during the transition of the housing into its starting position relative to the cartridge, the lower side of the engaging projections, which is formed angled, enables a sliding of the engaging element over same and a transition of the engaging element from the engaging recess into the neighboring engaging recess.

The engaging element can be formed circumferentially along the entire inner circumference of the housing or as an engaging arm arranged at a site of the inner circumference. In the case of an engaging arm, the metering device as a rule comprises at least two engaging elements formed as engaging arms for a satisfactory operation of the metering device. The at least two engaging arms in this case are preferably arranged distributed uniformly over the inner circumference of the housing. It is also possible to provide several, for example, three or four, engaging arms.

Accordingly, the engaging recesses on the piston can also be formed either circumferentially on the piston or, in the case of the formation of the engaging element as at least one individual engaging arm, only in those areas of the piston which are opposite the at least one engaging arm of the housing.

A design of the invention provides that the housing has a substantially circular cross-section. The entire housing here has a cylindrical shape. Such a housing form rests particularly well in the hand of the user and facilitates the use. Corresponding to a housing with circular cross-section, the cartridge as well as the piston also ideally have a circular cross-section. In principle, other cross-sectional shapes are also possible, for example, elliptical or polygonal shapes, as long as the cross-sectional shapes of housing, cartridge and piston are coordinated with respect to one another in such a manner that the highly viscous product can be dispensed as intended.

According to a design of the invention, the housing of the metering device is designed so as to be slip-resistant on its outer side, so that a user can actuate the metering device without slipping on the housing functioning as a handle unit. For this purpose, the outer side of the housing can comprise, for example, grooves extending perpendicularly to the direction of use, or nubs applied distributed over a certain area. In addition or alternatively, the housing can be provided with a rubber-like coating. Additionally or alternatively, the housing can also comprise gripping depressions on its outer side, whereby the handling of the metering device can be facilitated further.

According to an additional design of the metering device according to the invention, a cover cap is provided, by means of which the dispensing opening can be closed. The cover cap can be attached onto the cartridge and/or the housing, so that, in any case, the dispensing opening of the cartridge is closed and the highly viscous product retained in the receiving space is prevented from premature curing. On the cover cap and on the cartridge or on the housing, corresponding snap-in means and/or sealing means can be provided, so that the cover cap, due to snapping in, is held reliably on the metering device and seals off the receiving space even better, in order to thus further minimize the likelihood of an air and/or moisture entry. At the same time, in the attached state, the cover cap can function as a standing surface for the metering device, for example, during storage or presentation on a sales surface.

A proposal of the invention provides that on the piston at least one sealing element for a sealing between the piston and the cartridge is formed. In this way, it can be ensured that the highly viscous product remains within the receiving space and does not get past the piston into the area of the engaging element and of the engaging recesses. The at least one sealing element can be formed, for example, as a sealing ring arranged along the circumference of the piston, wherein the piston can comprise a corresponding circumferential receiving groove for receiving such a sealing ring. It is possible that only a single sealing element is provided; however, several sealing elements arranged substantially parallel to one another can also be provided. In addition to the sealing action relative to the highly viscous product, the at least one sealing element in addition brings about an increase in the friction between the piston and the cartridge, so that, as already explained above, after actuation of the metering device and during the returning movement of the housing into its starting position, the piston does not also perform this returning movement but instead remains in the position assumed during the course of the actuation of the metering device, advanced within the housing, until a new actuation of the metering device moves the piston further toward the first end of the housing.

It is possible to provide that the end of the cartridge comprising the dispensing opening is formed as an application head which can be set on the substrate. Such an application head can be formed so that it functions as a spacer between the dispensing opening and the substrate, so that the dispensing opening does not come in direct contact with the substrate.

A design of the invention provides that the cartridge is replaceable. In this case, the metering device is not disposed of as a whole after the cartridge has been emptied completely. Instead, only the emptied cartridge is removed from the housing and disposed of, while the rest of the metering device can be used again. For this purpose, a new cartridge is introduced into the housing, wherein any protective films or the like which are present, which in the case of a cartridge designed as a refill pack prevent unintentional escape of the highly viscous product, first have to be removed. A locking mechanism, for example, in the form of a safety catch formed on the housing, can be provided, by means of which a cartridge introduced into the housing can be secured, and which can be released to remove an emptied cartridge from the housing. In this way, a reusability of the metering device is possible, whereby waste can be reduced. In addition, the refillability of the metering device provides a price advantage for the consumer, since only new cartridges need to be purchased, and not the entire metering device. In the end, it is also conceivable that, after an emptied cartridge has been removed, in order to meet a corresponding demand, a cartridge containing another product is inserted into the metering device, whereby a very high flexibility in the use of the metering device is achieved.

It can be provided that the housing comprises areas wherein a filling quantity of the highly viscous product can be read. The areas can be openings in the housing wall, but also areas of the housing which are formed out of a transparent material, so that it is possible to read a remaining filling quantity or a number of actuation procedures that can still be performed with the metering device based on a scale. Such a scale can be arranged on the piston, for example. In this way, a user can easily calculate whether the remaining filling quantity is sufficient for a planned procedure, which is particularly important in the case of adhesives.

As material for the housing, the cartridge and the piston, it is possible to use hard polyethylene (HDPE), for example. HDPE is an extremely stable and resistant thermoplastic plastic. The spring element can be formed out of metal, for example, as a coil spring.

The metering device according to the invention is oriented in particular toward the do-it-yourself sector. The housing typically has a length between 10 cm and 25 cm and an outer diameter between 2 cm and 7 cm, preferably an outer diameter between 3 cm and 4 cm. In this way, it is ensured that the metering device rests well in the hand and can be operated with one hand.

The filling volume of a typical metering device is 15 to 50 g, preferably approximately 30 g. Here, the metering device can be designed, for example, to yield 20 dose units at 1.5 g. Due to the precise metering mechanism, the user can easily calculate how many dose units of the product he must dispense for a certain purpose. In the case of an adhesive, the quantity of adhesive necessary for holding a given weight is generally known or indicated on the packaging. Due to the easy and precise meterability, the user can thus easily determine and precisely dispense the necessary quantity of adhesive.

An inventive metering device with a highly viscous product, for example, a structural adhesive, is also disclosed.

The dispensing opening can be formed as a circular or elliptical opening. However, it can also have a symmetric or asymmetric shape different from these shapes. Thus, for example, it can be designed in the form of a star or in the form of any polygon.

With the inventive metering device, highly viscous products can be applied on substrates having any orientation, i.e., both on horizontally oriented workpieces, substrates, floors or ceilings and on workpieces, substrates or walls oriented vertically or at any other angle with respect to the horizontal. The actuation of the metering device can here always be carried out with one hand. The inventive metering device is characterized inter alia by the fact that the components forming the engaging mechanism are arranged outside of the product mass and are not in contact with said product mass. In this way, air- and moisture-curing highly viscous products can be metered by means of the inventive metering device at precise points and without additional auxiliary means.

BRIEF DESCRIPTION OF THE DRAWINGS

Below, the invention is explained in further detail in reference to an embodiment example and in reference to the drawings. In the drawings:

In FIGS. 1 to 4, a metering device referred to as a whole with the reference numeral 1 for the metered application of structural adhesive onto a substrate 2 is represented.

Figure 1:
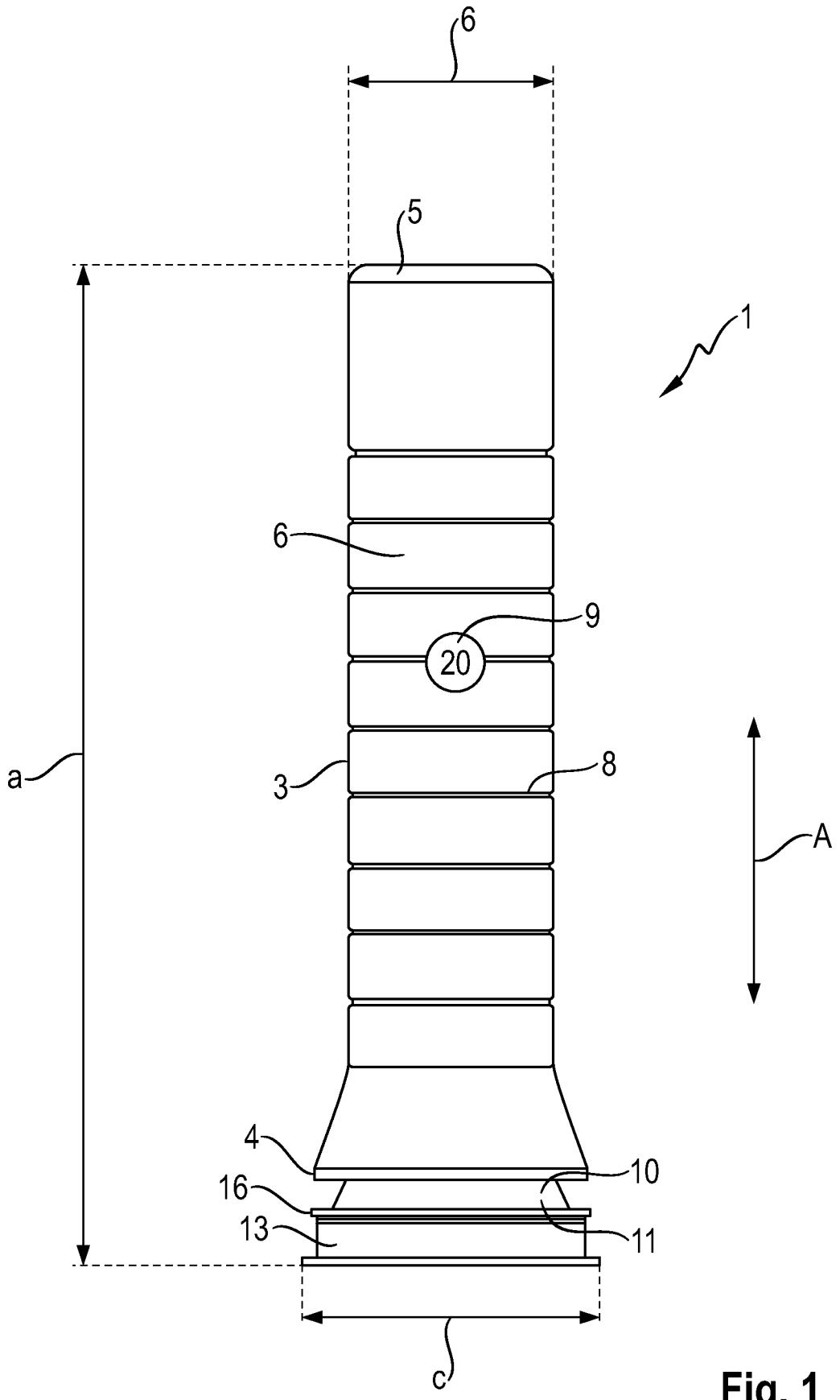
FIG. 1 shows a view of an inventive metering device.

The metering device 1 comprises a substantially cylindrical housing 3 which comprises a first end 4 and a second end 5, and an outer side 6 and an inner side 7 facing the inner space of the housing 3. On its outer side 6, the housing 3 is provided with grooves 8 which have a slip-resistant effect. Moreover, the housing 3 comprises an opening 9 through which a scale can be seen, by means of which a filling quantity of the structural adhesive contained in the interior of the housing 3 can be read. The scale here indicates how many actuation procedures still can be performed with the metering device 1. In the example of FIG. 1, 20 actuation procedures can still be performed with the metering device 1.

A cartridge 10 is arranged substantially within the housing 3. In FIG. 1, only a lower area 11 of the cartridge 10, which protrudes at the first end 4 from the housing 3, can be seen. The substantially cylindrical cartridge 10 forms a receiving space 14 for the structural adhesive to be metered. Both the housing 3 and the cartridge 10 are configured in the shape of a bell on the first end 4 and in the lower area 11, respectively. In other words, the cross-section of the cartridge 10 and of the housing 3 increases in these areas. The housing 3 is mobile relative to the cartridge 10 in the directions indicated by arrows A.

Figure 2:
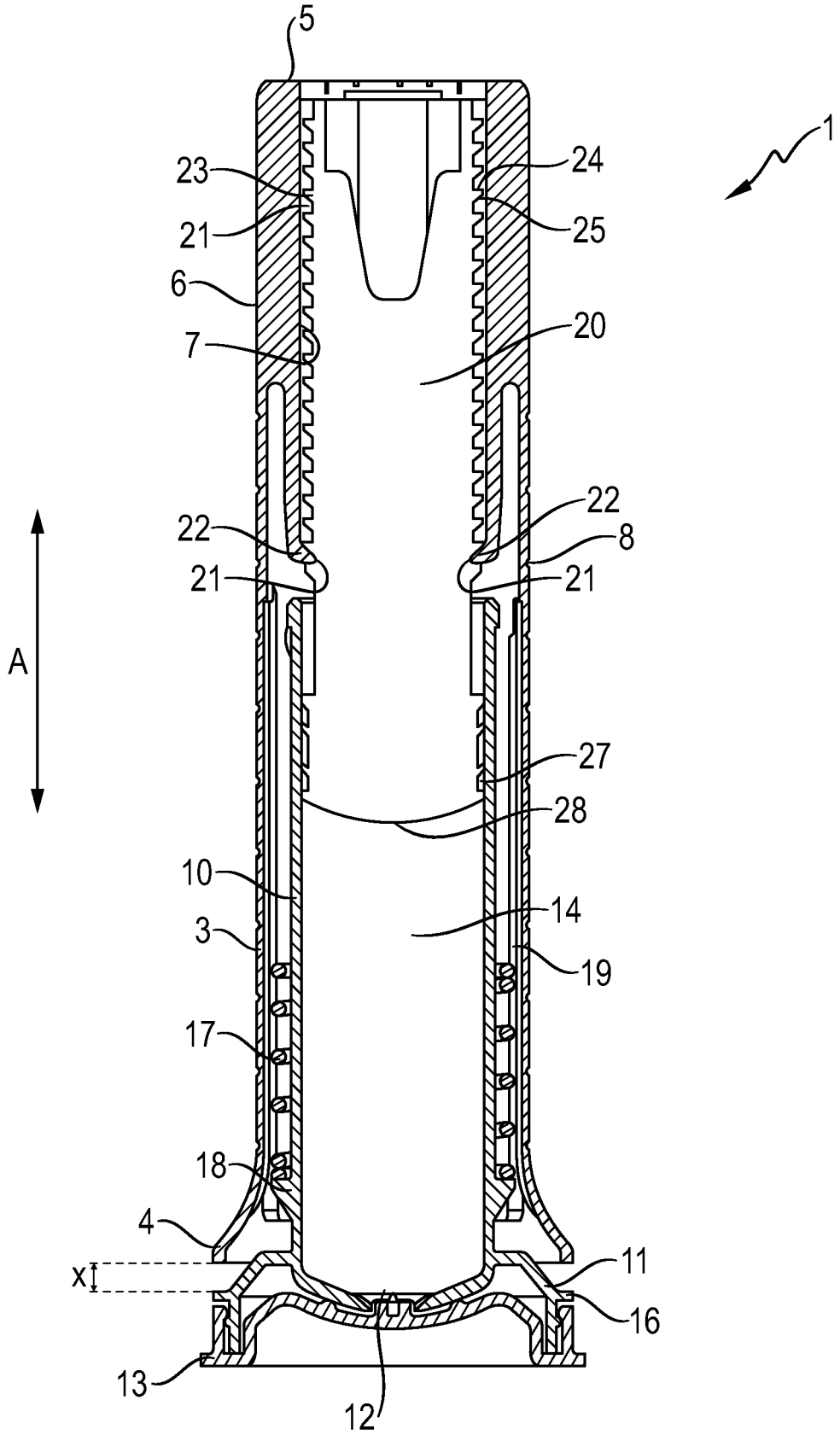
FIG. 2 shows representation of the metering device from FIG. 1 in longitudinal cross-section.

In the lower area 11 of the cartridge, a dispensing opening 12 is arranged, through which the structural adhesive can be dispensed from the cartridge 10. In the representation of FIGS. 1 and 2, the dispensing opening 12 is closed by a cover cap 13.

The cartridge 10 is formed in the lower area 11 thereof as an application head which, after removal of the cover cap 13, with an actuation of the metering device 1, can be set by means of a circumferential margin 15 on the substrate 2. The dispensing opening 12 is arranged recessed with respect to the circumferential margin 15, so that when the metering device 1 is set by means of the margin 15 onto a substrate 2, the dispensing opening 12 is not in direct contact with the substrate 2. This is apparent in particular in FIG. 3, in which the metering device 1 is represented during an actuation procedure.

In the lower area 11, the cartridge 10 moreover comprises a circumferential projection 16 which, during an actuation procedure of the metering device 1, serves as a stop for the housing 3, as will be explained further below.

Between the cartridge 10 and the housing 3, a metal coil spring 17 is arranged, the windings of which run around the cartridge 10. The coil spring 17, on its end facing the dispensing opening 12, rests on a circumferential margin 18 formed on the cartridge 10 and it is supported against said margin. On the end of the coil spring 17 facing away from the dispensing opening 12, projections 19 arranged on the inner side 7 of the housing 3 can engage, which compress the coil spring 17 when the housing 3 is moved relative to the cartridge 10, as will be explained even more precisely.

On its end facing away from the dispensing opening 12, a piston 20 is introduced into the cartridge 10. The piston 20 delimits the receiving space 14 in a direction opposite the dispensing opening 12. The piston 20 comprises engaging recesses 21. Engaging arms 22 formed on the inner side 7 of the housing 3 can engage into these engaging recesses 21. The engaging recesses 21 are delimited by engaging projections 23 which comprise an upper side 24 facing the second end 5 of the housing 3, and a lower side 25 facing the first end 4 of the housing 3. In the case of a metering device 1 set on a substrate 2, the upper side 24 of the engaging projections 23 is oriented substantially parallel to the substrate 2, while the lower side 25 of the engaging projections 23 is oriented at an angle of approximately 45° relative to the substrate 2.

In the area of its end 28 facing the dispensing opening 12, circumferential sealing elements 27 are formed on the piston 20 for a sealing between the piston 20 and the cartridge 10. In other words, due to the sealing elements 27, structural adhesive is prevented from coming out of the receiving space 14 defined by the cartridge 10 and delimited by the end 28 of the piston 20, in the direction of the second end 5 of the housing. In particular, due to the particular arrangement, structural adhesive is prevented from coming in contact with the engaging arms 22 and the engaging recesses 21.

The metering device 1 shown in FIGS. 1 to 4 has a length a of approximately 150 mm, a housing diameter b of approximately 32 mm, and a diameter c of the cover cap 13 of approximately 45 mm. Depending on the density of the structural adhesive used, a filling quantity of approximately 30 g of structural adhesive can be received in the cartridge 10.

Below, an actuation procedure of the metering device 1 is described. For the application of structural adhesive onto the substrate 2, first the cover cap 13 is removed. In this starting position the engaging arms 22 are each located in an engaging recess 21. The metering device 1 is then set by means of the margin 15 formed on the cartridge 10 onto the substrate, wherein a user grasps the metering device 1 in the area of the housing 3 provided with grooves 8. The housing 3 is then moved toward the substrate 2. Due to the engaging between engaging arms 22 and engaging recesses 21, the piston 20 is moved with the housing 3. Thus, the piston 20 is moved along within the cartridge 10 toward the dispensing opening 12 of the cartridge 10, thus pushing a defined quantity of structural adhesive out of the opening 12.

Figure 3:
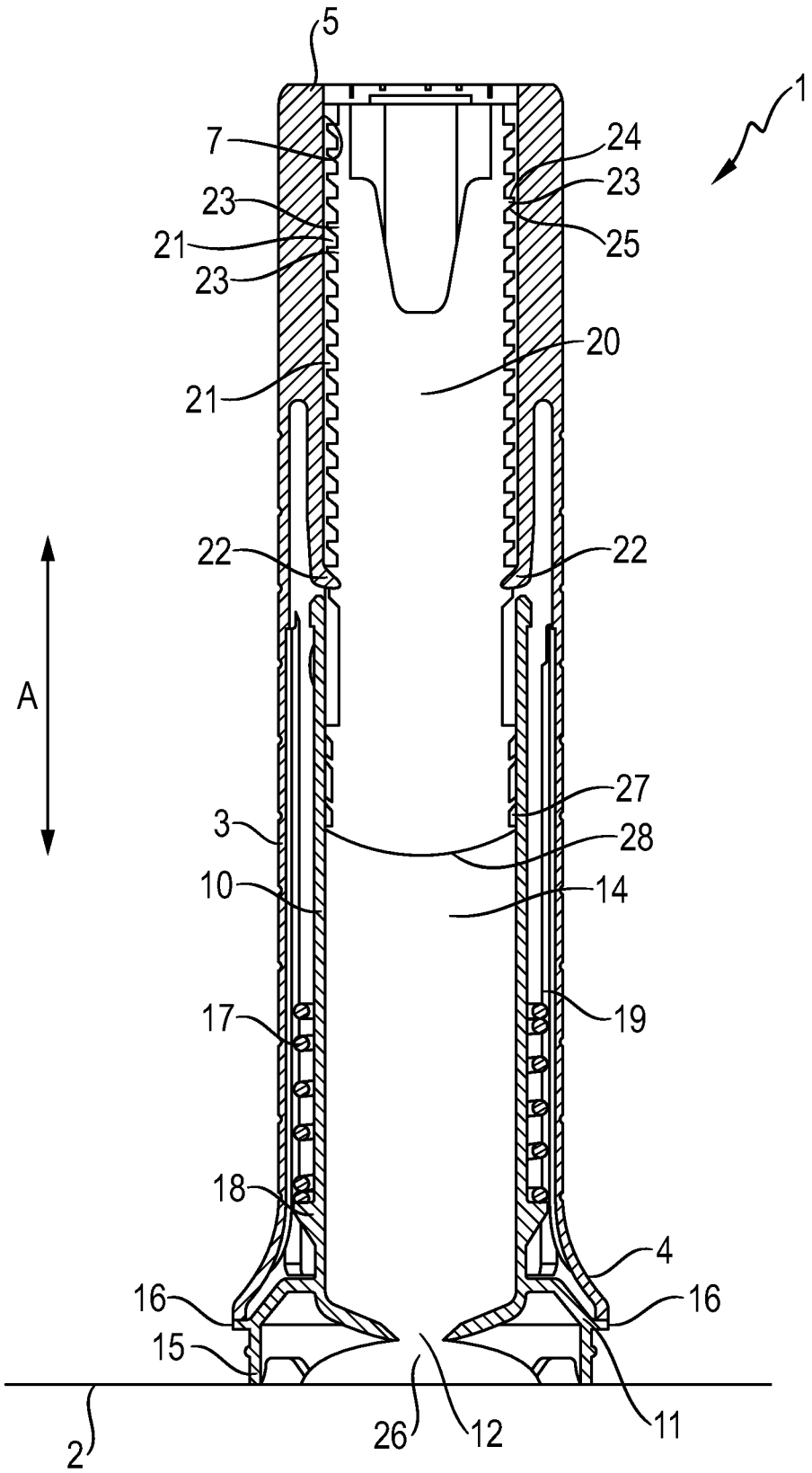
FIG. 3 shows a cross-sectional representation of a metering device during an actuation procedure.

The length of the distance x by which the housing 3 and along with said housing the piston 20 are moved during an actuation procedure, also referred to as stroke of the housing 3, is limited by the circumferential projection 16 formed on the cartridge 10, which the housing 3, by means of the end 4, finally hits by means of the end 4 thereof, see FIGS. 2 and 3. In FIG. 2, the metering device 1 is represented in its starting position, but with cover cap 13 still attached to it. Here, the distance x can be seen, by which the housing 3 can be moved from its starting position and limited by the circumferential protrusion 16. In FIG. 3, the metering device 1 is shown in a position in which the first end 4 of the housing 3 hits circumferential projection 16.

The distance x by which the housing 3 and thus the piston 20 is moved with each actuation procedure is thus fixed by the position of the circumferential projection 16, so that, in this way, the volume of structural adhesive dispensed with each actuation procedure due to the piston advance is fixed at the same time. In the case of the embodiment example shown, for each actuation procedure, an adhesive dot 26 of approximately 1.5 g of structural adhesive is dispensed. Depending on the viscosity of the structural adhesive used, such an adhesive dot 26 can cover an area of approximately 7 to 12 $cm^2$. In the case of a total filling quantity of approximately 30 g of structural adhesive, 20 adhesive dots 26 can be dispensed in this way with the metering device 1. Typically, such an adhesive dot 26 can have an adhesive strength of approximately 330 g.

During the movement of the housing 3 toward the substrate 2, the coil spring 17 is compressed. As already mentioned, the coil spring 17, on the end thereof facing the dispensing opening 12, rests on a circumferential margin 18. Projections 19 arranged on the inner side 7 of the housing 3 engage on the end of the coil spring 17 facing away from the dispensing opening 12 and compress the coil spring 17 during a movement of the housing 3 directed at the substrate 2. The maximum compression of the coil spring 17 achievable during the course of the actuation of the metering device 1 is reached when the housing 3 hits the circumferential protrusion 16. FIG. 3 shows this state, but the compression of the coil spring 17 is only suggested here and not represented true to scale.

Figure 4:
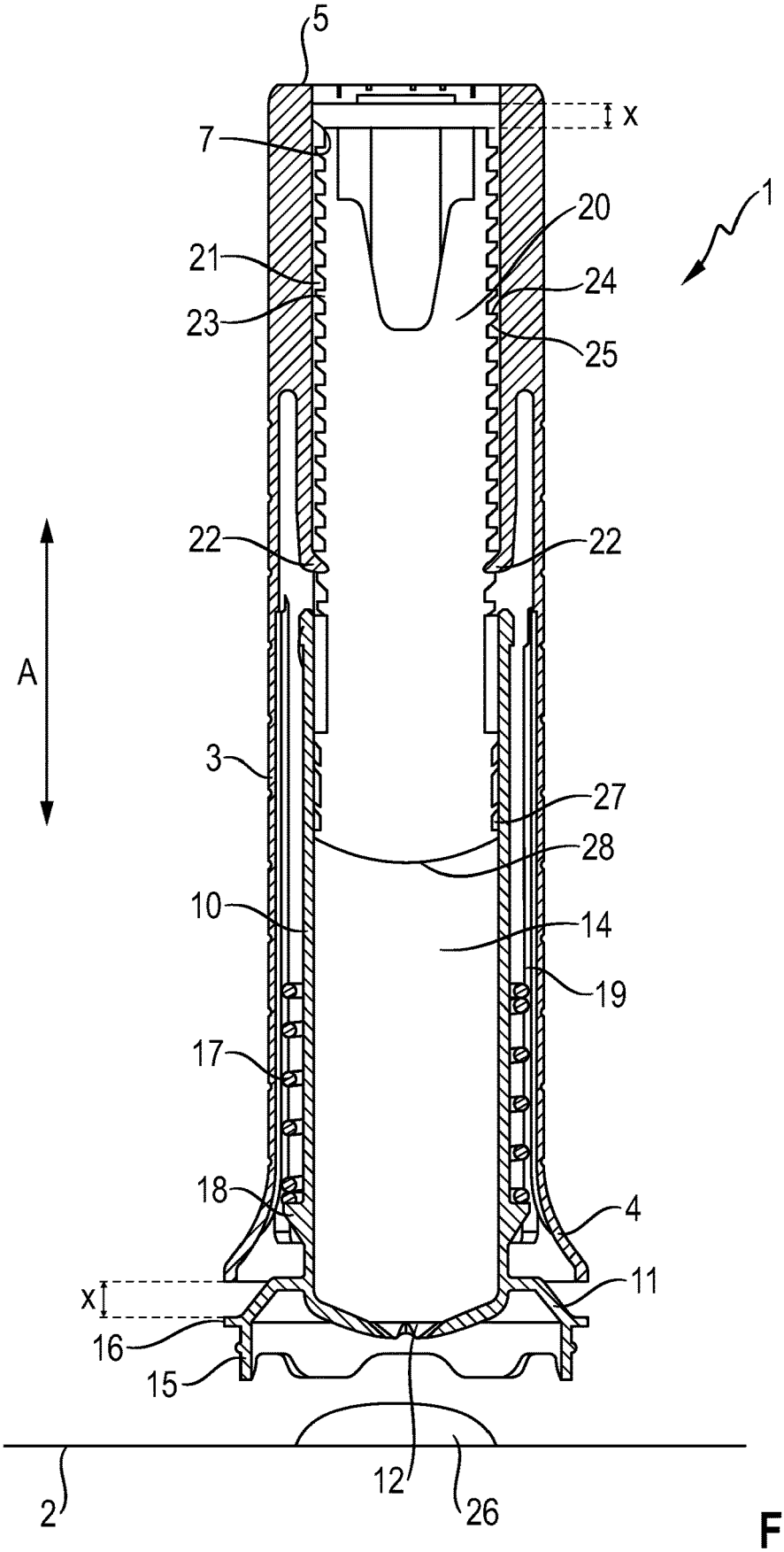
FIG. 4 shows a cross-sectional representation of a metering device after completion of an actuation procedure.

As soon as the housing 3 has hit the circumferential projection 16, the dose of structural adhesive provided for is dispensed from the dispensing opening 12, and the metering device 1 can be removed from the substrate 2, wherein the applied adhesive dot 26 remains as intended on the substrate 2, see FIG. 4. When the metering device 1 is separated from the substrate 2, the housing 3 and the cartridge 10 move relative to one another back to their starting position due to the resetting force of the coil spring 17, so that the first end 4 of the housing 3 is again at distance x from the circumferential projection 16.

During this returning movement of the housing 3 relative to the cartridge 10, the piston 20, on the other hand, remains in the position advanced by distance x within the cartridge 10, due to the friction forces generated by the sealing elements 27 between the piston 20 and the cartridge 10. The engaging arms 22 formed on the housing 3 here slide from their respective engaging recess 21 into the neighboring engaging recess 22 in direction of the second end 5 of the housing, see also FIGS. 3 and 4. Due to the above-described different orientations of lower side 25 and upper side 24 of the engaging projections 23, and due to a slightly flexible design of the engaging arms 22, this sliding can take place particularly well. The different orientations of upper side 24 and lower side 25 have the effect that, during the actuation of the metering device 1, the engaging arms 22 in each case engage firmly into an engaging recess 21 and lie on the upper side 24 of the corresponding engaging projection 23, thus ensuring the transmission of the movement of the housing 3 to the piston 20, while, after the actuation of the metering device 1 and when the housing 3 transitions into its starting position, the lower side 25 of the engaging projections 23, which is formed angled, enables a sliding of the engaging arms 22 over said lower side and a transition of the engaging arms 22 from the respective engaging recess 21 into a neighboring engaging recess 21.

In this position, the metering device 1 is now ready for a new actuation, wherein, according to the above explanations, the piston 20 is advanced ever further toward the dispensing opening 12 from actuation procedure to actuation procedure, while the housing 3 and the cartridge 10 after each actuation procedure resume their starting position relative to one another.

The engaging mechanism described has the effect that, with each actuation procedure, the same defined quantity of structural adhesive is always dispensed, wherein a premature curing of same within the cartridge 10 can be prevented due to the particular arrangement of the individual components of the engaging mechanism outside of the structural adhesive volume. As a result of the successive advance of the piston 20 within the cartridge 10, a simple way of dispensing the structural adhesive volume completely from the cartridge 10 is possible, without the need for additional auxiliary means for this purpose, as is the case with corresponding adhesive tubes, for example. The actuation of the metering device 1 can here always be done with one hand.

The invention claimed is:

1. A metering device for the metered application of a highly viscous product onto a substrate, comprising:

a housing with an inner side and an outer side, a first end which faces the substrate during actuation of the metering device and a second end opposite from the first end, wherein the housing comprises a housing opening in the area of the first end, a cartridge which is arranged at least substantially within the housing, and which forms an internal receiving space for the highly viscous product, wherein the cartridge comprises a cartridge opening in the area of the first end of the housing through which the highly viscous product can be dispensed from the metering device onto the substrate, a piston which is arranged within the housing and at least partially within the cartridge and which forms a delimitation of the receiving space opposite the cartridge opening, wherein, during the actuation of the metering device, a movement of the housing relative to the cartridge brings about a movement of the piston relative to the cartridge in the direction of the dispensing opening, whereby the highly viscous product can be dispensed through the cartridge opening and the housing opening, a spring element disposed between the inner side of the housing and the cartridge, the spring element having an extended position and a compressed position, wherein axial movement of the housing relative to the cartridge to dispense the highly viscous product moves the spring from the extended position toward the compressed position and spring element movement toward the extended position biases the housing toward a starting position, at least one engaging element formed on the inner side of the housing and a row of engaging recesses is formed on the piston, wherein both the engaging element and the engaging recesses are arranged outside of the receiving space, the engaging element engageable into one engaging recess with an actuation of the metering device, so that, movement of the housing relative to the cartridge provides movement of the piston relative to the cartridge and thus a dispensing of the highly viscous product from the metering device, and after an actuation of the metering device, the spring element biases the housing into the starting position during which the engaging element moves from the engaging recess into a neighboring engaging recess.

2. The metering device according to claim 1, wherein the engaging recesses on the piston are delimited by engaging protrusions which comprise an upper side facing the second end of the housing and a lower side facing the first end of the housing, wherein, in the case of a metering device set on a substrate, the upper side of the engaging protrusions is oriented substantially parallel to the substrate, while the lower side is oriented at an angle of 30° to 60° with respect to the substrate.

3. The metering device according to claim 1, wherein the at least one engaging element is formed as a circumferential engaging element along the entire inner circumference of the housing.

4. The metering device according to claim 1, wherein the at least one engaging element is formed as an engaging arm.

5. The metering device according to claim 1, wherein the housing has a substantially circular cross-section.

6. The metering device according to claim 1, wherein the housing is formed to be slip-resistant on the outer side thereof.

7. The metering device according to claim 1, comprising a cover cap sealingly engaged to the dispensing opening.

8. The metering device according to claim 1, wherein at least one sealing element for sealing between the piston and the cartridge is formed on the piston.

9. The metering device according to claim 1, wherein the end of the cartridge comprising the dispensing opening is formed as an application head which can be set on the substrate.

10. The metering device according to claim 1, wherein the cartridge is replaceable.

11. The metering device according to claim 1, wherein the housing comprises areas in which a filling quantity of the highly viscous product can be read.

12. A metering device for the metered dispensing of a highly viscous product onto a substrate, comprising:

a cartridge having an outer wall, an inner wall defining an internal receiving space for containing the highly viscous product, a first end defining an aperture through which the highly viscous product can be dispensed onto the substrate and an open second end;

a housing disposed around the cartridge, the housing having an inner side, a portion of the inner side adjacent the cartridge outer wall, an outer side, a first end adjacent the cartridge first end and a second end opposite the first end and extending beyond the cartridge second end, the inner side comprising an engaging element, the housing axially movable between a starting position wherein the housing first end is displaced away from the cartridge first end and a dispensing position wherein the housing first end is displaced toward the cartridge first end;

a bias element disposed between the inner side of the housing and the outer wall of the cartridge, the bias element having an extended position biasing the housing toward the starting position and a compressed position when the housing is in the dispensing position;

a piston substantially disposed within the housing, the piston having a first end disposed in the cartridge receiving space to seal highly viscous product therein, a second end proximate the housing second end, an outer wall comprising a row of engaging recesses outside of the cartridge receiving space and adjacent the housing inner side, wherein a first of the engaging recesses is interengaged with the housing engaging element so that movement of the housing toward the dispensing position moves the piston first end toward the cartridge first end.

13. The metering device of claim 12 wherein movement of the housing from the dispensing position toward the starting position moves the housing engaging element from the first engaging recess to a second engaging recess axially displaced toward the piston second end from the first engaging recess.

* * * * *